United States Patent [19]

Leclerc et al.

[11] 4,203,453

[45] May 20, 1980

[54] PROCESS FOR THE REPETITIVE AND OPTIMALIZED LAYOUT OF SHAPES HAVING THE DETERMINED CONTOUR OF A CIGAR WRAPPER WITHIN EACH OF THE ELEMENTS OF A SERIES OF TOBACCO LEAVES

[75] Inventors: Jean-François Leclerc, Orleans; Pierre Waegaert, Bordeaux, both of France

[73] Assignee: Service d'Exploitation Industrielle des Tabacs et des Allumettes, Paris, France

[21] Appl. No.: 920,152

[22] Filed: Jun. 29, 1978

[30] Foreign Application Priority Data

Jul. 4, 1977 [FR] France ..... 77 20437

[51] Int. Cl.[2] ..... A24C 1/00; A24B 7/00

[52] U.S. Cl. ..... 131/20 R; 131/15 R

[58] Field of Search ..... 131/15, 16, 14, 8, 20 R; 2/243 B

[56] References Cited

U.S. PATENT DOCUMENTS 683,453 10/1901 Ertheiler ..... 131/14

*Primary Examiner*—Stephen C. Pellegrino

*Attorney, Agent, or Firm*—Jacobs & Jacobs

[57] ABSTRACT

A process for the repetitive and optimalized layout of shapes having the determined contour of a cigar wrapper within each of the elements of a series of tobacco leaves or half-leaves (having an irregular shape and defects), with a view to cutting out and removing from said elements wrappers having said shapes, in which process at least one sample leaf is determined having dimensional characteristics inferior to those of the whole section of the series of the leaves to be cut out, then, for each of the sample leaves, cut out pattern cards are drawn up, each comprising the outline of a possibility, distinct from the others, of cutting a leaf similar to the sample leaf into said shapes of determined contour, wherein said pattern cards relating to the same sample leaf are graded into groups, as a function of their decreasing yield of wrappers, the pattern cards within the same group are graded as a function of at least one criterion other than that of yield and relative to the interest of use presented by said pattern cards, there are superposed in turn, on each of the leaves to be cut out having dimensional characteristics at least equal to those of a sample leaf, the pattern cards corresponding to this latter sample leaf in the above order of grading and the first pattern card is retained as cut out pattern for each leaf, on which the outlined shapes of wrappers, constituting the domain of said card, are not superposed on a defect in the leaf to be cut.

8 Claims, 13 Drawing Figures

PROCESS FOR THE REPETITIVE AND OPTIMALIZED LAYOUT OF SHAPES HAVING THE DETERMINED CONTOUR OF A CIGAR WRAPPER WITHIN EACH OF THE ELEMENTS OF A SERIES OF TOBACCO LEAVES

The present invention relates to a process for the repetitive and optimal lay-out of shapes of determined contour in a series of tobacco leaves, or like pieces.

In the cigar industry, it is known that the outer leaves of natural tobacco (or wrappers) in which the cigars are wrapped are cut out from tobacco leaves previously flattened by means of various devices, then removed by suitable members before being transferred to the application members.

It is an object of the present invention to enable the maximum number possible of wrappers without defects to be cut out from each leaf (or half-leaf), this being highly important in view of the high price of the leaves or cigar wrappers.

To this end, the invention relates to a process for the layout of shapes having the determined contour of a wrapper, with a view to their being cut out from a series of tobacco leaves (or half-leaves) of irregular shape and having defects, which process will be applied successively to each of the leaves (or half-leaves) of tobacco constituting the batch to be treated.

In the same batch of leaves (or half-leaves), the leaves differ, within certain limits, as to dimensions, and may each present random defects (tears, cracks, holes, large ribs) rendering the zone where they are located unsuitable for making usable wrappers. The midrib of a whole leaf constitutes a "defect" like the others, but it is always present (at least over the greater part of the length of the leaf). The case of the half-leaves stripped from either side of the midrib and that of the whole leaves therefore differ only by the presence, in the second case, of a very apparent defect. To simplify the following specification, only the stripped half-leaves will be taken as example, indicating if necessary the measures to be taken with whole leaves.

A batch of half-leaves constitutes a "series", in which only right-hand or only left-hand half-leaves are found (the notion of right and left being defined when the leaf is held in the hands as if it were in its natural habit on the plant), of the same origin and same variety of tobacco.

The majority of these half-leaves will therefore be somewhat similar in shape (such batches may include several millions of half-leaves). If, moreover, the leaves have been sorted by foliar level on the plant, by classes of length or according to several of their dimensional characteristics, the process of layout will be further simplified. However, such batches may still represent several hundreds of thousands of half-leaves (right-hand or left-hand) and therefore be concerned by the process according to the invention and justify the studies prior to its application.

The wrappers (or binders if a leaf of natural tobacco is provided under the outer leaf) to be laid out in the half-leaves are of known, stable dimensions. There is nothing to prevent wrappers from being cut out from a half-leaf which do not all have the same format and are intended for cigars of different types (the type depending on the section and/or the length). The problem of the optimal layout according to the invention will not be complicated by this, but the preliminary study will be longer, this not having any influence on the overall yield of the process; the possible increase in the optimalisation time will be compensated for by the saving of material made by associating different formats. To simplify the specification, it will be assumed that only wrappers of one and the same format are sought on a determined batch of half-leaves. Generalisation to wrappers of different format will be indicated and made without problem.

Furthermore, it is conventional that the secondary veins included in the format of the wrappers be as concealed as possible. The larger parts of these veins are preferably located in the wrapper so as to be covered when the cigar is rolled and every effort is made that they are totally absent from certain zones of the futur cigar (tip). Moreover, these veins must be oriented so as to be substantially parallel to the axis of the cigar. The process of the invention enables all these requirements to be taken into account.

The application of the process of the invention, in its most general form, requires relatively important preliminary work.

In a first phase, it consists in selecting at least one and preferably several tobacco leaves chosen as being the most representative of the series to be treated and/or corresponding as best possible to the wrappers to be cut out. These leaves will be designated in the following specification as "sample leaves".

The sample leaves may be selected from three main families in each of which it will be possible to choose one or more sample leaves of the series, according to the cases of application. The number of sample leaves chosen varies from one series to the next but is generally reduced to a few units.

A family of sample leaves will be constituted by what may considered as the "lower bounds" of the series in question: by superposition, all, or almost all, the leaves of the series could completely cover at least one (if there are several) of the sample leaves chosen as lower bounds, after having been oriented in the best possible manner. The rare leaves not complying with this condition will be the only ones to escape, at least in a first analysis, the process of optimal layout. It may also be said that the outer contour of a leaf of the series may always include the outer contour of a lower bound-sample leaf.

The second family may be constituted by one or more sample leaves qualified as "medians". Each of these would allow a division of the assembly constituted by the series of leaves to be cut out: the dimensional characteristics of a large section of the series will be superior (or at the most almost equal, apart from the cut-out margins) to those of the sample leaf corresponding to this section. Each of the leaves of the section could entirely include, after the most favourable orientation, this sample leaf within its outer contour.

The third family may be constituted by sample leaves qualified as "limits", which are more delicate to define. A limit sample leaf is that from which cutting out supplies (being assumed to be totally exempt of defects) a precise number of wrappers with the minimum waste possible, i.e. the minimum of surface of the leaf outside the pieces. Like the preceding ones, these latter sample leaves may be ideal and have no exact representative in the series of leaves. However, their general appearance will be as close as possible to that of a large number of leaves of the series (in the same way as for the median standard leaves, apart from the dimensions) and their outer contour will be as non-complex as possible, within the preceding limit: it will not present more angles and/or convexities than the majority of the leaves of the series show. The limit sample leaves chosen will be easily outlined by juxtaposing wrappers to be cut out and removed (by taking into account, if necessary, their preferential orientation and the cut-out margins), and by varying their respective arrangement until the curve enveloping all the juxtaposed wrappers resembles as much as possible, by its general appearance, the contour of a median sample-leaf.

Other families of sample leaves may also be envisaged by a study of probabilities from the population constituting the series of leaves, for example by taking into account the frequency of appearance of a defect in such and such region of the leaves.

Once the choice of the sample leaves is made, the preliminary work continues as follows: for each sample-leaf chosen (and except for what is stated at the end of the preceding paragraph, assumed to be totally free from redhibitory defects), all the possible arrangements of wrappers included in the outer contour of this piece will be sought.

Of course, to solve the problem, one may be satisfied with incremental displacements of the wrappers with respect to one another. Moreover, experience has shown that this work may be simplified by processes of automatic calculation or by optical processes which are less expensive than manual drawing and give the result a high precision. For each sample leaf, a catalogue of "cut-out pattern cards", abbreviated hereinafter to "pattern cards", fairly similar to sewing patterns will therefore be drawn up, which would all give, in the absence of defects on a real leaf, identical to the sample leaf, a possible indication of cut; by suitable transfer of a pattern card on a real leaf, likewise free from defects, of a template larger than that of the sample leaf (i.e. the corresponding sample leaf is entirely inscribed inside the contour of the leaf in question, as if said latter were a higher limit of a series to which the sample leaf belongs), one is certain in advance of being able to cut out as many wrappers from said leaf as the pattern card comprises.

It is then necessary to grade all the pattern cards obtained: this hierarchy may be organized according to various criteria and with at least two possible reference systems: firstly, all the pattern cards relative to the same sample leaf may be graded into "groups" as a function of the "yield" of wrappers obtained. If there is only one format of wrappers, the grading will naturally be made in decreasing function of the number of wrappers which the pattern card to be graded gives. The group of rank N (the highest) of such pattern card will give N identical wrappers, the group of rank (N-1) will give N-1 and the group 1 (of lowest rank) will only give one. These pattern cards may then be graded, within their group, according to a criterion relative to the interest of use, or a criterion of quality (for example direction of the secondary veins), or a criterion of probability (the frequency of the defects in such and such zone of the leaves rendering the valid cut-out of a leaf according to such and such pattern card more or less probable). To avoid any confusion with the groups marked by a figure, this grading may be represented by an index letter (a, b, c) or even an exponent if there are more than 26 cards per group. If there are several possible formats of wrappers to be cut out, the grading into groups of pattern cards will be less automatic: the criterion of yield may take into account the relative value given to the different shapes (for example preference will be given to the wrapper having the largest area, and so on) or saving of material will be more important (the least waste surface possible) or a certain relative proportion will be imposed between the different formats. This latter criterion may, moreover, be associated with the other two. Within the same group, the rank of a pattern card will be allocated as for the pattern cards of uniform cut-out format, according to a criterion of preference depending above all on the type of the material of the pieces to be cut out.

Once this preliminary work is effected, it is preferable to continue the study in a manner which is one of the characteristics of the method according to the invention. This work consists in "superposing" various pattern cards to extract therefrom the "preselection cards". The term "superpose" here indicates both a real superposition (for example with the aid of tracings) and a virtual superposition, the pattern cards in question having been memorised in a computer which will effect various intersections therebetween. This superposition will of course be made, if the pattern cards issue from the same sample leaf, by exactly overlapping the contours of the pattern cards representing the outer template of the sample leaf. If the pattern cards are relative to different leaf-types, this superposition will be made by taking into account their gradation or, in the general case, this superposition will be effected (similarly to the "centred transfer" of a sample leaf on a piece to be cut out) by causing the main static central axes of the leaves to merge, said leaves being assumed to have a uniform surface mass. Main static central axes are understood to mean the axes passing through the centre of gravity of the leaf with respect to which the static moment of said leaf is either maximum or minimum.

This superposition will preferably be effected in the first place for all the pattern cards corresponding to the same sample leaf and to the same group. In the majority of cases, it will make it possible to show that one or more regions of closed contour belong to all the wrappers figuring within each of the pattern cards of the group, i.e. to the "inner domain" or "domain" of each pattern card. The outline of the contour of these regions, accompanied by that of the contour of the corresponding sample leaf (or its main static central axes) will constitute, transferred on a support or memorised in a computer, a preselection "card" for the layout process. The interior of these regions will constitute the domain of this preselection card.

In fact, the following may already be noted: by superposing, as stated above, a preselection card and a leaf to be cut out of larger format (i.e. the contour of the first is totally included in the contour of the second), it will be verified whether a pattern card of the group is suitable as cut out pattern of said leaf. In fact, if a defect in the leaf to be cut out appears in the domain of the preselection card, it will be certain that it is not possible to cut out from the leaf examined, at least within the outer contour of said card, as many wrappers as figure on the corresponding pattern cards; or, in the case of always identical leaves to be cut out, as many as the index P, P being included between N and 1, of the group of pattern cards represented by the preselection card (N is the index of the group of highest rank). The possibility of cut out (P-1) afterwards will be examined later.

All the superpositions of a leaf and of a card, pattern card or preselection card, are effected by giving the leaf and the card identical "orientations", i.e. for lack of other bases, by merging the main static central axes of the leaf and of the sample leaf relative to the card, or commensurable with said latter (for a card resulting from a plurality of sample leaves, it is then question of the smallest sample leaf). However, by acting as hereinabove, one will be sure that the outer cut-out margin, (i.e. the width of the zone included between the outer contour of the leaf and that of the selection card) will be as well distributed as possible. These superpositions are effected in turns on each leaf when they are subjected to the layout process.

When, for a group of pattern cards, the regions common to all the wrappers carried by the cards do not exist (i.e. the intersection of the domains of all these cards is empty), or when it is desired (and this is the most interesting) to continue the selection by elimination, one will proceed as follows: Work similar to that of the establishment of the preselection cards will be carried out, but at the level of the sub-groups of pattern cards relative to the same sample leaf.

According to the very definition of a sub-group, the wrappers represented on the pattern cards of such a sub-group all have at least one common secondary feature (in addition to their outer format and to their number). This may be, for one of the wrappers, a fixed position or a fixed orientation, or a variable orientation within certain limits about a fixed point, etc. (fixed being understood here to be with respect to the contour of the reference sample leaf). The pattern cards of the same sub-group will therefore always have, if the dimensions of this sub-group are well chosen, at least one common domain (after superposition, as stated hereinabove). It will already be understood that the contour of this or these common domains, accompanied by the contour common to the pattern cards of the sub-group, may serve as "delection card", in the same way as a preselection card was previously used.

In fact, by superposing (with the same significance for this word as for a preselection card) a selection card and a leaf to be cut out of larger format, it may be specified whether the possibility of cut-out foreshadowed with the preselection card of the group still exists for all the pattern cards of the sub-group from which said selection card results: if there is a defect in the leaf to be cut out within the domain of this latter card, this possibility will be zero. In the contrary case, it will be relatively high if the sub-groups are well constituted: for it to become zero again, it would in fact be necessary for a plurality of distinct defects (or a defect of very large extent) to affect, on the leaf to be cut out, each of the following regions: regions defined when each of the pattern cards of the sub-group are projected onto the leaf and when the whole domain common to these pattern cards is subtracted from the projected zones (therefore the domain of the selection card used at the beginning, which zone is already known to be free from defects). The probability of such a distribution of the defects (total absence in the regions figuring on the selection card, simultaneous presence of defects on all the regions defined previously) is, in general, not very likely. This level of probability is naturally assessed as a function of the probability of presence of a defect in any zone of the leaf. This probability will generally be less great as the definition of the sub-group is narrow and coherent.

The relationship of the area of the domain of the selection card of a sub-group with respect to the area outside this domain and within the contour is a good indicator of coherence: when this relationship is close to the unit, the above probability is at least twice as small as that of a defect of any zone of the piece. It will be even less if the zone of the sample leaf outside the domain of the selection card offers numerous possibilities, independent of one another, of laying out one or more wrappers.

This will be all the more so as a group will be divided into sub-groups comprising a reduced number of pattern cards for which the degrees of freedom of displacement of certain wrappers will themselves be reduced. If, for example, all the wrappers represented on the pattern cards of a sub-group, except one, occupy, in all these cards, a fixed location (the same in all the cards), one wrapper only will be mobile. On the contrary, the greater this mobility, and, better, the more independent (i.e. not overlapping by superposition) the positions of the mobile wrapper will be, the higher the probability for one of the pattern cards of the assembly of the sub-group of pattern cards to suit. Such an assembly (defined according to the preceding criterion, or another criterion such as the limited displacement of certain wrappers, by varying their only orientation about a fixed point) may be called "specialised sub-group" and the corresponding selection card "specialised selection card".

The search for the optimal pattern card for an individual leaf to be cut out may thus be effected in several stages: the preselection card of the group of highest rank, or N, is firstly applied thereto (if such a card is "empty", one will obviously begin at the level of the sub-groups of highest rank: see following stage). If a defect appears in the piece to be cut out in the region or regions defined by this preselection card, it will be useless to try the selection cards of the sub-groups of rank N: the preselection card of lower rank (N-1) will be employed, with the same remark as hereinabove. In the contrary case, the selection cards of the sub-groups of rank N (one will start here if the preselection card is empty or does not exist) will be applied to the piece in the "hierarchical" order. In the case of presence of a defect in the region defined by the selection card of the first sub-group (sub-group of index Na for example), one passes to the second selection card (sub-group Nb) and so on. It is noted that with the confirmed hypotesis of absence of defect coinciding with the preselection card N, the search is limited to the regions figuring on the selection cards N and not figuring on the preselection card; this work not having to be effected twice, the selection cards may, if there is a preselection card, represent, in addition to their contour, only the regions outside the region or regions figuring on the preselection card. The same does not apply to the successive selection cards, the same defect being able to be present successively in several superposable regions of different cards.

As soon as a selection card proves possible, the search enters, at least provisorily, into a new phase. In certain types of layout, it will be preferable to superpose on the individual leaf to be cut out, successively, all the pattern cards of the sub-group from which this selection card has been elaborated. The first suitable pattern card will then be retained (no defect in the regions of this card not figuring on the selection card, nor, of course, on the possible preselection card). This card will give an optimal cut-out pattern of the piece, since the groups, sub-groups and pattern cards have been graded according to their interest (yield, quality, etc..). In other problems, specialised selection cards will firstly be used, this restricting the number of potentially suitable pattern cards to be tried after each "possible" response to a selection card. The selection to one degree only or to two degrees will be a question of case of species, the second being all the more indicated as the number of pattern cards will be high in the same sub-group. This will often be so for the groups of non-maximum rank as to the sample leaf in question.

If all the selection cards of the group of rank N give non-favourable responses or if, after having provisorily retained one or more, it proves that all the pattern cards of the sub-group or sub-groups envisaged are not suitable (because there are inevitable defects outside the regions figuring on the selection cards), the search may begin in the same way at the level of the group of pattern cards of rank (N-1) and, possibly, so on up to the group of rank 1 (one wrapper only to be cut from the leaf). It is highly probable that if N differs considerably from 1 there will be no need to go that far. In the rare contrary cases, the work may be continued up to and including this lever for which there will certainly not be a preselection card. However, the selection cards corresponding to well constituted sub-groups will make it possible, if desired, to ascertain fairly rapidly whether there is a possibly of cutting at least one wrapper without defect from the leaf.

The search may also be effected by leaving out a group of intermediate rank (for example N-1) if, during elimination of the pattern cards of rank N, it appears that the probability of suitability of one of the pattern cards of intermediate rank is very low. An examination of the pattern cards of rank ($N^{-2}$) would possibly enable a return to rank ($N^{-1}$) if it rapidly gave a favourable response.

If it is feared that this search will take more than a set time, for example when the device for cutting out the leaves operates synchronously or in line with devices directly using the cut out wrappers, the search may be interrupted at a pre-set group of rank included between N and 1, without departing from the scope of the invention: the time saved on the period allocated to the layout may be a factor of optimisation. The leaves for which no pattern card is found could, like those for which no pattern card is really adequate (with the wrappers taken into account in the preliminary study) be transferred to another manufacture (smaller wrappers for example).

In the particular, but frequent case of the defects being located for the most part on the periphery of the leaves to be cut out, another gradation of the search is possible. Let us assume that it has been determined, as before, that none of the pattern cards, of rank P, drawn up for a sample leaf corresponding the best to the examined piece to be cut out, is suitable. It is still possible that a pattern card, of maximum rank, drawn up for a sample leaf of format smaller than that of the preceding one, is perfectly suitable.

Instead of examining whether the pattern cards of rank ($P^{-1}$) corresponding to the first sample leaf are suitable, the (possible but still most probable) preselection card may be presented which corresponds to the group of rank immediate adjacent P, probably (P or $P^{-1}$) of the closest sample leaf of smaller format. By proceeding in this way by degrees, the marginal zones of the leaf where the majority of defects are concentrated, will be successively eliminated.

In this way, the outer cut-out margin will be increased, producing, on the contrary, less waste in the central zone on the leaves. The search therefor will be accelerated, all the more so as preselection cards may most often be used before the actual selection cards.

Similarly, to accelerate the search, it is possible to constitute the sub-groups of pattern cards of the same rank and to grade these sub-groups by taking as basis the probable localisation of the defects. If the zones common to the same sub-group (or common domain) constituting with the contour of the sample leaf the corresponding specialised selection card, cover the regions of the sample leaf where the defects have the maximum chance of being located, it is obvious that the absence of defects in these zones makes it possible to envisage with optimism the possibility that at least one pattern card of the sub-group is suitable. In order only to have to try the minimum of actual pattern cards, the specialised selection cards may therefore be classified according to this criterion (decreasing probability for a defect to figure in a zone of the leaf corresponding to the domain of a specialised selection card). The risk of having to try several of this type of card in vain will be largely compensated by the reduction in the risk of having to try without success numerous pattern cards that a reverse grading would involve.

In summary, the invention consists, in its broadest sense, in a repetitive process for the optimal layout of wrappers within each of the elements of a series of leaves, with a view to cutting out and removing the wrappers from said leaves, in which process at least one sample leaf is determined having dimensional characteristics inferior to those of the whole section of the series of leaves to be cut-out; for each of the sample leaves retained, cut-out pattern cards are drawn up, each comprising the outline of a possibility, distinct from the others, of profitable cut-out of the said wrappers from a leaf similar to the sample leaf, then said pattern cards relating to the same sample leaf are graded into groups as a function of their decreasing yield of wrappers, the pattern cards within a group are graded as a function of another criterion and, to optimalise the layout, there are superposed, in turn, on each of the leaves to be cut-out having dimensional characteristics immediately superior to those of a sample leaf, the pattern cards corresponding to this latter sample leaf, in the above order of grading and finally, the first pattern card is retained as cut-out pattern for each leaf, for which the outlined wrappers (constituting the domain of said card) are not superposed on a defect of the leaf to be cut-out.

The pattern cards of the same group having equal wrapper yield and corresponding to the same sample leaf may be graded according to a criterion of quality of the wrappers which these pattern cards would allow to be cut-out from a leaf without defect.

Alternately, the pattern cards of such a group may be graded as a function of the possibility for a defect of a leaf to be cut-out to be included, by superposition, in the domain of the pattern card in question.

A plurality of sample leaves (at least two) are preferably determined for a series of leaves to be cut-out having a relatively important dispersion of the dimensional characteristics of said leaves.

For the leaves having dimensional characteristics superior to those of a first sample leaf which is not the smallest, pattern cards of greater yield corresponding to this first sample leaf are firstly superposed, according to the general characteristic of the invention. However, for that leaf for which none of the preceding pattern cards is suitable, it may be preferable after these latter leaves to superpose pattern cards corresponding to a second sample leaf and of characteristics immediately inferior to the first. Thus, the defects which may be found in the margin of said leaves between the outer contours of the first of the sample leaves on the one hand and the second on the other hand will thus no longer be taken into account. If none of the pattern cards of higher yield corresponding to the second sample leaf is suitable, the operation of superposition will preferably be started again with pattern cards corresponding to the first sample leaf and of yield immediately below that of the pattern cards of the first group tried.

According to the preferred embodiment of the invention, the pattern cards of the same group are firstly superposed, immediately after grading into groups. In this way, a preselection card is drawn up of which the inner domain will be the intersection of the inner domains of all the pattern cards of the group. This preselection card will be graded at the head of the group in question. Thus, before superposing the pattern cards of this group and a leaf to be cut-out, the preselection card of the group is superposed thereon. The operation will have to be continued with the selection cards of this group only if there is no defect in the leaf to be cut-out in the domain of the preselection card.

To benefit from the eliminatory faculty of the cards resulting from the superposition of a plurality of pattern cards, it will be expedient, as this is a further preferred embodiment of the invention, to divide at least one group of pattern cards into sub-groups. This division will obviously be made according to a criterion other than the quantitative yield which is the same for all the pattern cards of one group. The criterion retained may be a criterion of quality or a criterion of probability as hereinabove, for the grading of the pattern cards within the group. It will then be quite suitable to superpose all the pattern cards of the same sub-group to draw up a selection card of which the domain will be the intersection of all the inner domains of the pattern cards of the sub-group. Such a selection card will be graded at the head of the pattern cards of the corresponding sub-group. Thus, before superposing the pattern cards of one sub-group on a piece to be cut-out, said selection card will be superposed thereon. The operation of superposition of the pattern cards of a sub-group will be continued only if no defect in the leaf appears in the domain of the corresponding selection card.

When, for the same group, a preselection card and selection cards will have been drawn up successively for each of the sub-groups of said group, it will be advantageous to subtract from the inner domain of each selection card, the domain of the preselection card placed at the head of said group. In this way, the absence of a defect in the same zones, constituted by the domain common to a selection card and to the corresponding preselection card, will not have to be checked twice running.

The following embodiment of the process of the invention will be voluntarily simplified in order to abbreviate this specification. However, with what precedes, it will enable any one skilled in the art to understand how the invention may be carried out, the passage from one particular case to another being easy since it is only a matter of methodic preparation.

The accompanying Figures represent the phases of preparation for the application of the process:

Figure 3:
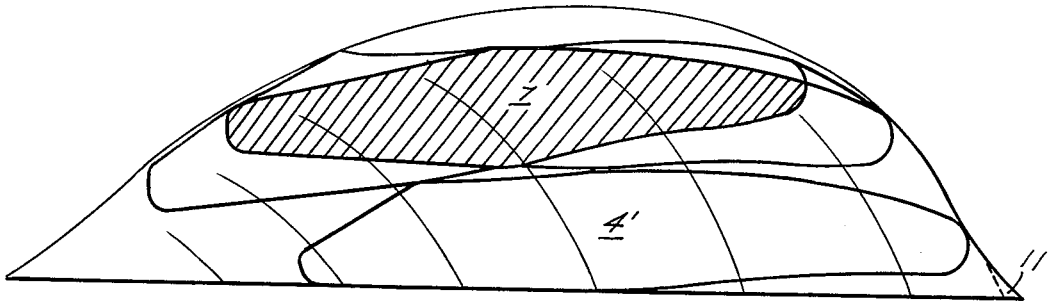
Figure 4:
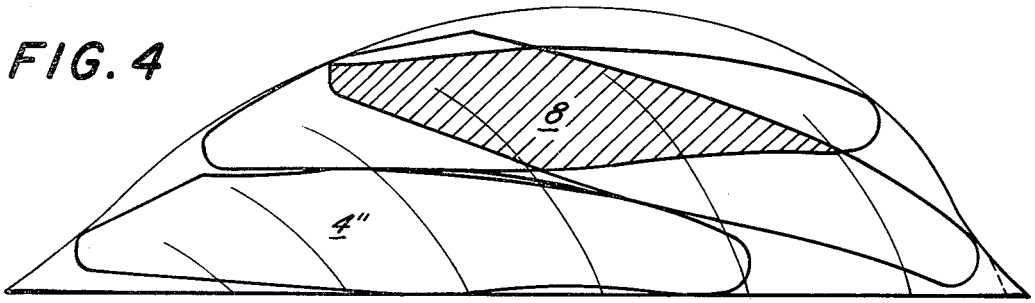
Figure 5:
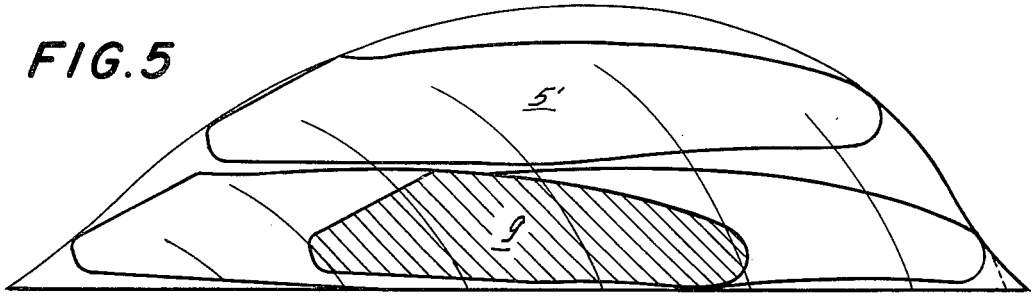

FIGS. 3, 4 and 5 on the one hand and 9, 10, 11 and 12 on the other hand show the elaboration of specialised selection cards.

Figure 6:
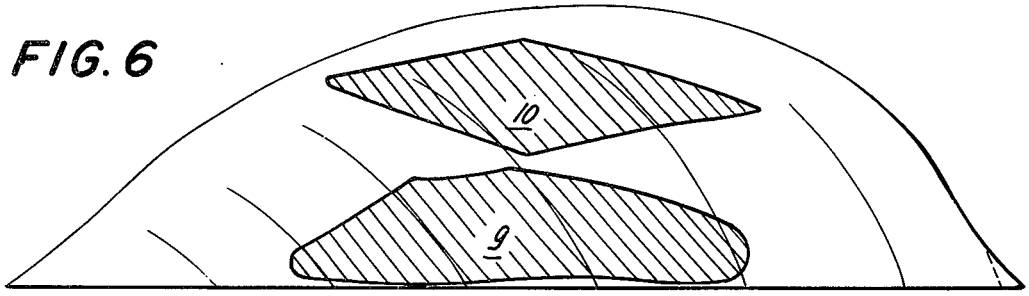
Figure 7:
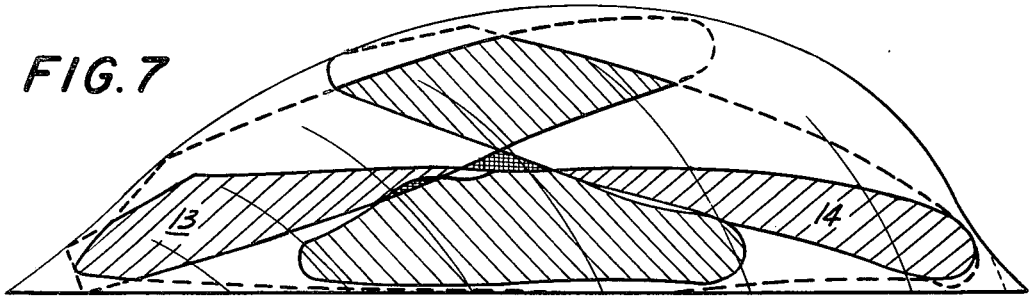
Figure 13:
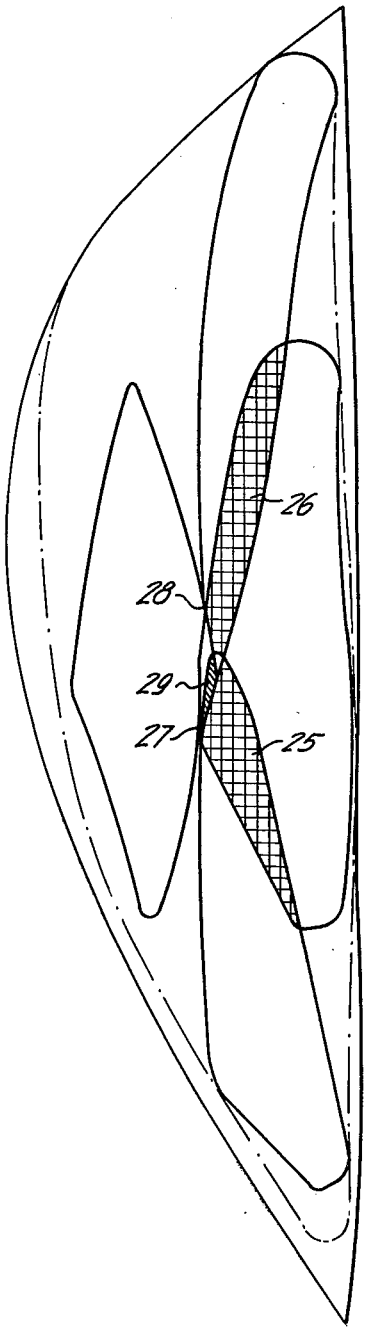

FIGS. 6, 7 and 13 are the synthesis of the preceding figures and show both the elements of selection cards and of preselection cards.

Figure 1:
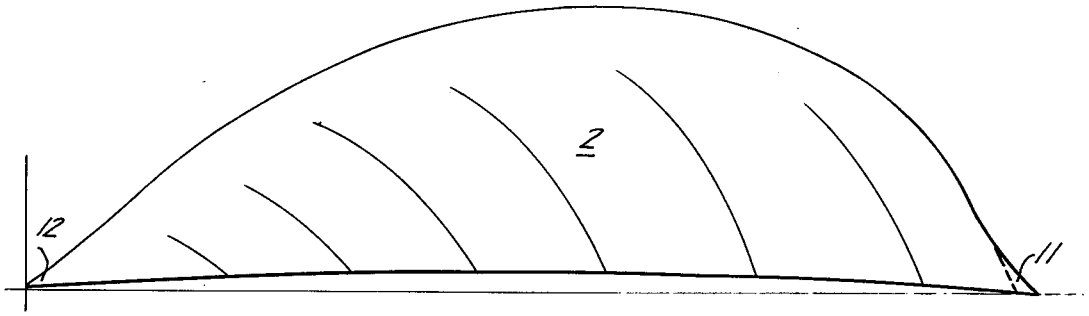
FIGS. 1 and 8 show two stripped half-leaves of tobacco, represented by their real contour and their secondary veins.
Figure 2:
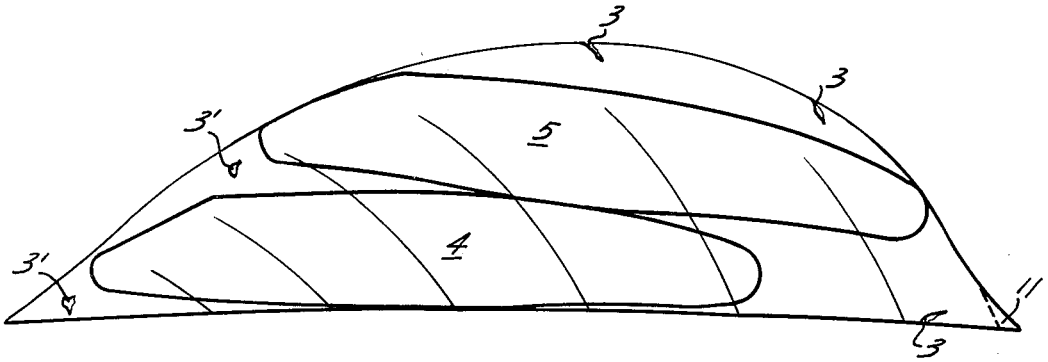
FIG. 2 shows an example of layout of two wrappers in the half leaf of FIG. 1.
Figure 8:
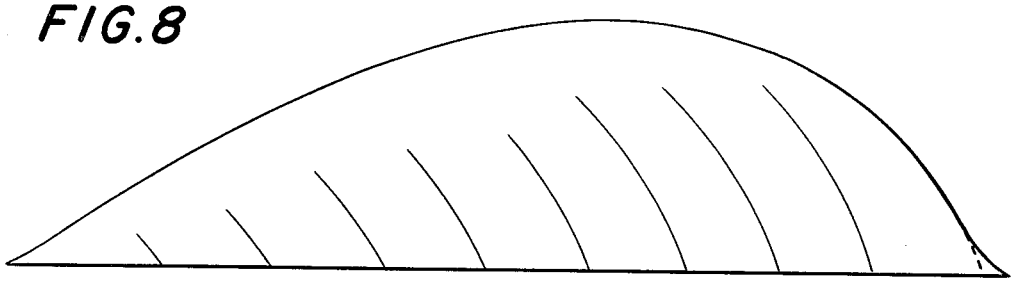

The stripped half-leaves shown in FIGS. 1 and 8 are of very similar length; they differ especially in their width. That of FIG. 1 allows, as indicated in FIG. 2, despite the presence of tears and holes (3 and 3'), the cut-out of two wrappers (4 and 5) indicated by their outer contour. The half-leaf of FIG. 8 enables only one wrapper to be cut-out, if the defects (not shown) which it contains are not distributed so as to prevent this wrapper from being usable. The orientation of the wrappers in the leaf is not arbitrary: for the secondary veins (2—2') to be substantially parallel to the axis of the wrapped cigar, it is necessary for wrappers of this type to have their main axis roughly parallel to the outline of the central rib cut-out (line at the bottom of the Figures).

For the elaboration of the selection cards, a half-leaf very similar to those of FIGS. 1 or 2 has been taken as sample leaf. In the first case, it may be assumed that one of the wrappers (4', 4'' and 5' in FIGS. 3, 4 and 5) verifies fairly exactly the condition of parallelism mentioned above. The different positions possible, in the absence of any defect, for another wrapper, are then located between two extreme positions, encircled by a thick line. The hatched zones 7, 8 and 9 of FIGS. 4, 5 and 6 are regions of the half-leaf which, in each of the cases, belong to all the possible positions of the second wrapper. Accompanied by the contour of this half-leaf, taken as sample leaf, and by the contour of the fixed wrapper (4', 4'' and 5' respectively) they may constitute a specialised selection card.

By superposing FIGS. 3, 4 and 5 so that the contours of the half leaf are merged, the zones 7 and 8 overlap partially in a zone 10 (FIG. 6). This zone 10 and the zone 9 represent regions in which it is imperative that there is no defect for two wrappers to be cut-out of a half-leaf such as that shown in FIG. 1. FIG. 6 therefore shows a preselection card for the layout of two wrappers in such a leaf. It is the one which will be tried in the first place.

If the response which it gives is favourable (no defect included within the contour of zones 10 and 9), it is possible to cut-out two wrappers from this half-leaf. The different selection cards (similar to FIGS. 3 to 5 but of which zones 9 and 10 will have been eliminated) will then be tried, in the order which allows the best orientation of at least one wrapper. As soon as one of these cards is suitable, the cut-out pattern cards will be tried in turn, said cards preferably being graded in the following order: that pattern card will be top-graded for which the contours of two wrappers are the most clearly distinct from the outer contours of the half leaf (it is in fact in this margin that the tears such as 3 most often appear) and so on, placing in last position the pattern cards for which these two categories of contour are adjacent or merge over the greatest length. As soon as a pattern card is suitable, the layout is terminated and it is optimal, since the number of wrappers which may be cut-out is the maximum and the orientation of the veins in the wrappers is the best possible.

If the preselection card of FIG. 6 gives an unfavourable response or if none of the selection cards is suitable, or if all the pattern cards introduced by one (or more) suitable selection cards prove to be unusable further to one or more defects in their domain, it remains to examine whether a wrapper may be cut-out from a half-leaf such as the one shown in FIG. 1 (or of a slightly larger format). Two solutions are then possible.

A first solution consists in conserving as sample leaf the outer contour of the leaf of FIG. 1 (with the exception of the peduncle 11 which gives no possibility of layout and, possibly, of the end tip 12 which is likewise only of little interest). The pattern cards and selection cards will have been drawn up as before for all the possibilities of laying out a wrapper in such a half-leaf. The superposition of all these pattern cards is shown in FIG. 7. Said latter obviously shows that certain zones (13, 14, 15 . . .) are also critical: the presence of a defect in zone 13, for example, will obviously indicate that it is not possible to cut-out a wrapper, one end of which will be located near the tip of the leaf. A defect in zone 14 would give the same indication for the vicinity of the petiole. The squared zones belong at the same time to several critical zones. Preliminary observation thereof may make it possible, in the case of a defect, to eliminate a large number of pattern cards at the same time.

Figure 9:
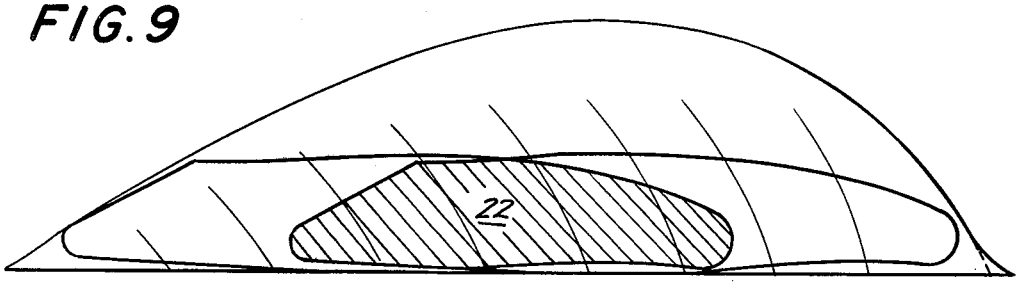
Figure 10:
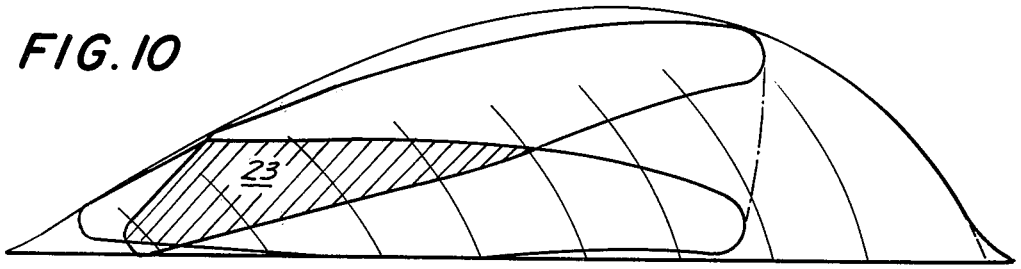
Figure 11:
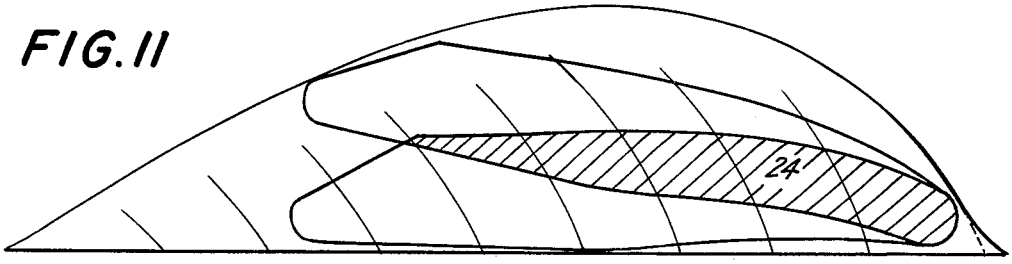
Figure 12:
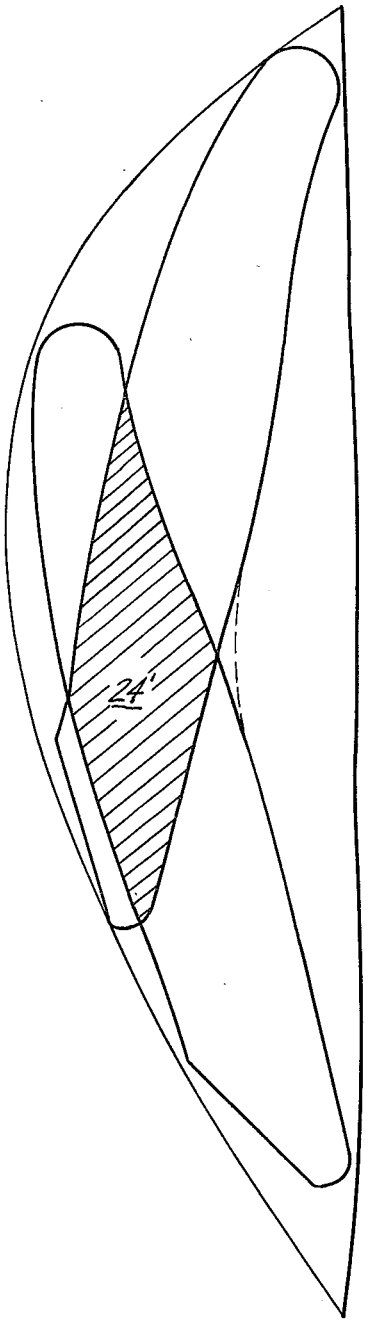

The other solution consists in changing sample leaf, taking for example a sample leaf of similar length but of smaller width and of which it is known that only one wrapper may be cut-out, as in the half leaf shown in FIG. 8. In this way, all the marginal defects are eliminated. Such a sample leaf is shown in broken lines in FIG. 13. FIGS. 9, 10, 11 and 12 show how different pattern cards may be regrouped to show zones common to the whole of a sub-group thereof. In FIG. 9 for example, the zone 22 belongs to all the wrappers having the best possible orientation vis a vis the veins 7' shown in FIG. 8. Similarly, in FIGS. 10, 11 and 12 appear zones 23, 24 and 25 obtained by making the wrapper which it is desired to cut-out take all the possible positions, starting from the preferred position in the direction of the dotted arrow (FIGS. 10 and 11).

By showing zones 22 to 24 at the same time on the same outline of the outer contour of the half-leaf, common zones 25, 26, 27, 28 and 29 are obtained. Zone 29 belongs to the four zones 23 and 24: a defect in this central region of the leaf indicates that none of the pattern cards is suitable. A half-leaf comprising a defect thus placed must be transferred and allocated to the cutting out of smaller wrappers. Zones 25 to 28 each belong to two of zones 22 to 24; a defect in zone 25 for example indicates that neither the orientations of wrapper indicated in FIG. 22 nor those indicated in FIG. 23 can be suitable. It is seen that these critical zones constitute selection cards (25 and 26 for example) whilst zone 29 is a preselection card.

By transferring on the same outline the curve enveloppe of the end and intermediate positions of the wrappers for each of the evolutions shown in FIGS. 9 to 12, a curve enveloppe is obtained within which all these evolutions are included. This curve enveloppe, outlined in broken lines in FIG. 13, may constitute the contour of a sample leaf for a wrapper which will be the lower bound of all the half-leaves larger than it, in all their dimensions. Other sample leaves for two, three wrappers or more (if there are very large half-leaves in the batch to be treated) may be elaborated in the same manner.

Although the example given relates only to natural tobacco leaves, it is seen that the process of the invention is applicable in a large number of industries, particularly those which deal with natural products having shapes and defects which are more or less random. Thus, the interest of the process is obvious for the leather industries, the shoe industry being a particularly suitable case of application. The transposition from the cigar industry to other industries of the process of the invention is simply effected by replacing in the preceding specification and in the claims, the words "leaves" and "wrappers" respectively by "flat pieces of irregular surface" and "shapes of determined contour".

What is claimed is:

1. A process for the repetitive and optimalised layout of shapes having the determined contour of a cigar wrapper within each of the elements of a series of tobacco leaves or half-leaves (having an irregular shape and defects), with a view to cutting out and removing from said elements wrappers having said shapes, in which process at least one sample leaf is determined having dimensional characteristics inferior to those of the whole section of the series of the leaves to be cut out, then, for each of the sample leaves, cut out pattern cards are drawn up, each comprising the outline of a possibility, distinct from the others, of cutting a leaf similar to the sample leaf into said shapes of determined contour, wherein said pattern cards relating to the same sample leaf are graded into groups, as a function of their decreasing yield of wrappers, the pattern cards within the same group are graded as a function of at least one criterion other than that of yield and relative to the interest of use presented by said pattern cards, there are superposed in turn, on each of the leaves to be cut out having dimensional characteristics at least equal to those of a sample leaf, the pattern cards corresponding to this latter sample leaf in the above order of grading, and the first pattern card is retained as cut out pattern for each leaf, on which the outlined shapes of wrappers, constituting the domain of said card, are not superposed on a defect in the leaf to be cut.

2. A process as claimed in claim 1, wherein, within a group of pattern cards, corresponding therefore to the same sample leaf and having an equal wrapper yield, the said pattern cards are graded as a function of the quality of the wrappers which they would allow to be cut out.

3. A process as claimed in claim 1, wherein, within a group of pattern cards, said pattern cards are graded as a function of the probability that a defect in a leaf coincides by superposition with the domain of the pattern card in question.

4. A process as claimed in claim 1, wherein at least two sample leaves having different dimensional characteristics are determined, and, for the leaves to be cut out having dimensional characteristics superior to those of a first sample leaf which is not the smallest, there are firstly superposed on these leaves pattern cards of higher yield corresponding to this first sample leaf, then, for those leaves for which none of the preceding pattern cards has been retained, pattern cards are then superposed on these latter leaves, corresponding to the second sample leaf of immediately inferior dimensional characteristics.

5. A process as claimed in claim 4, wherein, if none of the pattern cards of higher yield corresponding to the smallest of the sample leaves is suitable, the operation is repeated with the pattern cards of yield immediately beneath the optimum, from the first sample leaf in question.

6. A process as claimed in claim 1, wherein the pattern cards of the same group are superposed in order to draw up a preselection card on which figures the intersection of all the wrappers constituting the domain of said pattern cards and said preselection card is graded at the head of the pattern cards of said group, so that, before superposing the first of the pattern cards belonging to the group on a leaf to be cut out, said preselection card is superposed thereon and the operation of superposition of the other pattern cards of the group is continued only if no defect appears on the leaf in the domain of this preselection card.

7. A process as claimed in claim 1, wherein a group of pattern cards is divided into sub-groups according to a criterion other than their yield, all the pattern cards of a sub-group are superposed to draw up a selection card on which will figure the intersection of all the wrappers constituting the domain of said pattern cards and the selection card is graded at the head of the corresponding sub-group, so that, before superposing the pattern cards belonging to this sub-group on a leaf to be cut out, said selection card is superposed thereon and the operation of superposition of the other pattern cards of the sub-group is continued only if no defect in the leaf appears in the domain of this selection card.

8. A process as claimedin claim 6, wherein the domain of the preselection card of the group to which a selection card is attached is subtracted from the domain of said selection card so that it is not checked twice running that a defect on the leaf is really absent from the original domain to the two cards.

* * * * *